United States Patent [19]

Baselmans et al.

[11] Patent Number: 4,789,805

[45] Date of Patent: Dec. 6, 1988

[54] SUSPENSION MEANS FOR SHADOW MASK IN A CATHODE RAY TUBE

[75] Inventors: Antonius W. H. M. Baselmans; Adrianus J. C. van de Ven, both of Eindhoven, Netherlands

[73] Assignee: U.S. Philips Corporation, New York, N.Y.

[21] Appl. No.: 900,862

[22] Filed: Aug. 27, 1986

[30] Foreign Application Priority Data

Sep. 3, 1985 [NL] Netherlands ..... 8502404

[51] Int. Cl.[4] ..... H01J 29/07

[52] U.S. Cl. ..... 313/404; 313/402

[58] Field of Search ..... 313/404, 402, 406, 407

[56] References Cited

U.S. PATENT DOCUMENTS 4,164,682 8/1979 Palac ..... 313/404

4,358,702 11/1982 Gijrath et al. ..... 313/404

FOREIGN PATENT DOCUMENTS 56338 4/1980 Japan ..... 313/406

*Primary Examiner*—Leo H. Boudreau

*Assistant Examiner*—K. Wieder

*Attorney, Agent, or Firm*—F. Brice Faller

[57] ABSTRACT

Shadow mask is suspended from glass envelope by spring steel suspension elements which are connected to the envelope by metal connectors which are plastically deformed at low temperatures, avoiding thermal stresses on the glass.

10 Claims, 2 Drawing Sheets

SUSPENSION MEANS FOR SHADOW MASK IN A CATHODE RAY TUBE

Figure 1:
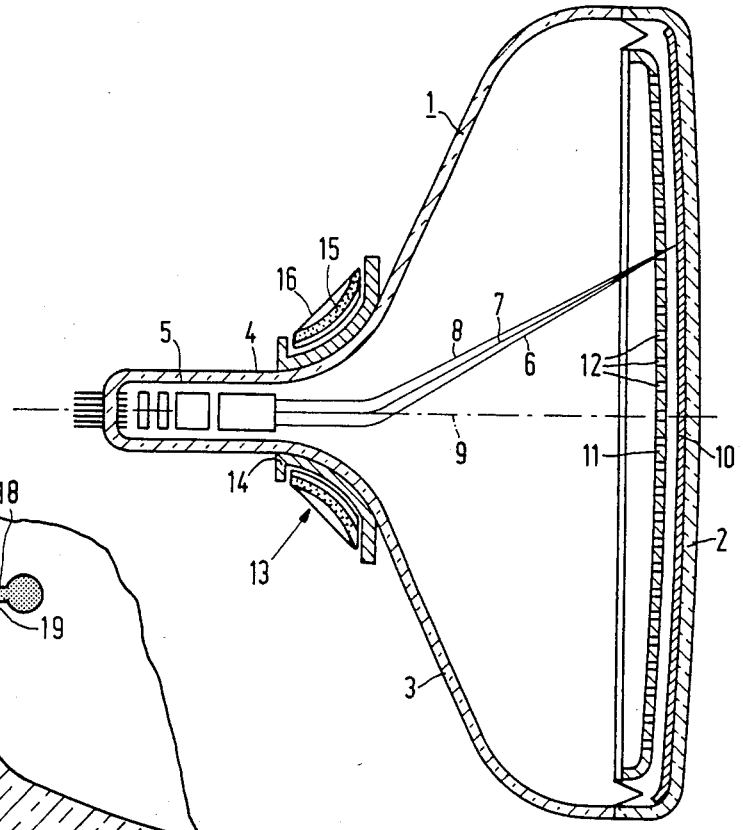

The invention relates to a method of manufacturing a cathode ray tube for displaying colour images, whose envelope is partly formed by a glass display window to which metal means are provided for suspending a colour selection electrode in the tube.

A method of the kind described in the opening paragraph is known, for example, from Netherlands patent application No. 7514157, to which U.S. Pat. No. 3,983,612 corresponds.

In such methods metal pins are used as suspension means. Positioning of the metal pins can be effected by high-frequency heating of the pins which upon contact with upright edges of the glass display window cause this window to melt locally. The pins are then partly sunk into the molten glass whereafter the glass is caused to solidify again.

The known technique has a number of drawbacks. In the known technique strict requirements are imposed on the compatibility of the properties of the glass and metal to be connected. For example, the thermal coefficients of expansion of the materials to be connected must not differ too much, and under the conditions of the method the metal must be wetted satisfactorily by the glass and the metal must be oxidized and/or vitrified.

The use of pins as suspension means leads to complicated constructions having comparatively many components which during further manufacture of the cathode ray tube must make it possible to detach the colour selection electrode repeatedly from the display window and to fix it accurately in the same place to the display window after the relevant operation.

These complicated constructions are related to the poor positioning accuracy of the method described in which pins are inserted into melted glass.

The process described is time-consuming and costly.

An object of the invention is, inter alia, to obviate the above-mentioned drawbacks at least to a considerable extent.

According to the invention a method of the kind described in the opening paragraph is therefore characterized in that the metal suspension means each comprise at least one mounting pad, the mounting pads being directly connected to the glass display window by respective metal connectors disposed between the display window and the mounting pads, said connectors being deformed under pressure at a temperature which is below the softening point of the glass of the display window, the softening point of the metal of the suspension means and the softening point of the metal of the connectors.

The invention is based on the recognition of the fact that prevention of a melting phase during connection of the glass window and the metal suspension means has many advantages.

It is found, for example, that the positioning accuracy of the connection between window and suspension means in the method according to the invention is much greater than in the known method described. As a result the further connection between suspension means and colour selection electrode can be effected in a simple manner with few components so that easy dismantling and accurate remounting of the selection electrode is possible.

The method according to the invention can also be carried out faster and at a lower cost and is carried out at a comparatively low temperature resulting in strong connections using little and thin material.

It is to be noted that it is known per se to make pressure bonds between glass and metal while using a metal connector. They are used when vacuum-tight connections are required. In order to obtain connections which meet the requirements it is desirable to use a sufficiently high deformation rate and deformation degree of the connector. It is up to those skilled in the art to choose these magnitudes dependent on the circumstances and/or to determine them by means of directed experiments.

The method according to the invention is particularly suitable when the suspension means are provided in corners of upright edges of a substantially rectangular display window.

In fact, many stresses occur in the corners of upright edges of a display window so that placing pins at those areas in the known manner easily leads to rejects, but on the other hand it is attractive to place suspension means in corners of upright edges with a view to the thermal behaviour of the colour selection electrode. The method according to the invention makes it possible to provide suspension means in the corners of upright edges substantially without any stress and without rejects.

The method according to the invention is also particularly suitable to provide suspension means in the corners of a flat display window substantially without any stress and without deformation.

In the known method of fixing by means of pins the glass surface is deformed. This is very undesirable with a flat display window whose surface must be used as much as possible for picture display. In the method according to the invention there is no deformation of the glass surface and the connection can be positioned very close to the edge of the display window.

The invention also relates to a cathode ray tube for displaying colour images and having an envelope which is partly formed by a glass display window with metal means connected thereto for suspending a colour selection electrode in the tube.

According to the invention this cathode ray tube is characterized in that the display window and the suspension means are connected together at mounting pads free from deformation through metal connectors which are plastically deformed at the area of the mounting pads.

The local deformation of the metal connectors can be determined on the cathode ray tube. The adhesion between the connectors and the display window at one end and the suspension means at the other end is in fact smallest firstly at the edges of the (deformed) connectors and secondly at the area where the connectors are thickest prior to the deformation that is at the centre of a connector having initially a circular cross-section and the surface of the connector is least deformed during deformation.

By interpositioning a deformable metal connector the difference in coefficients of expansion of the glass of the display window to be connected and the metal of the suspension means plays a comparatively minor role.

Although spring steel has a coefficient of expansion which differs considerably from that of the glass used for display windows, it is a very suitable construction material for the suspension means of the cathode ray tube according to the invention.

In practice, inter alia, aluminium and lead are found to be suitable as connectors. The combination of spring steel and aluminium is, for example, very suitable also because a low temperature is applied during connection.

In the cathode ray tube according to the invention there is a greater possibility of material choice and a greater freedom of design as regards constructions to be applied than in the prior art cathode ray tubes in which pins are sealed in glass. It is, for example, very easy to fix suspension means in the form of ball-headed pins to the display window.

In a preferred embodiment of the cathode ray tube according to the invention the connection line between a glass-metal mounting pad and a contact point of the colour selection electrode on the suspension means constitutes an acute angle with the glass surface. Thus in this construction of the cathode ray tube one is no longer bound to the construction in which the said contact point lies above the said contact pin.

Practice proves that suspension means provided with a bridge having at least one extremity, for example, at each extremity, a glass-to-metal mounting pad are very suitable.

Such constructions are successfully used for suspension means in corners of upright edges of substantially rectangular display windows or in corners of flat rectangular display windows.

In the case of a flat display window the perpendicular projection onto the glass surface of the connection point of the colour selection electrode to the suspension means may be located without any objection in the image plane.

Some embodiments of the invention will be described with reference to the drawing. In this drawing:

FIG. 1 is a diagrammatic longitudinal section through a cathode ray tube

Figure 3:
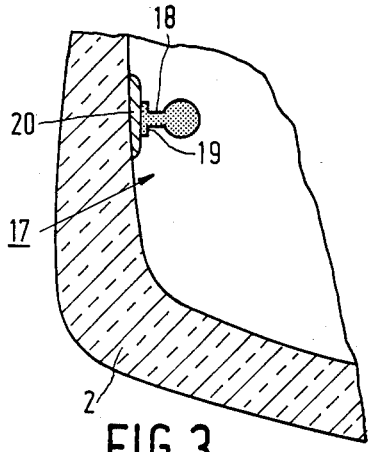
Figure 2:
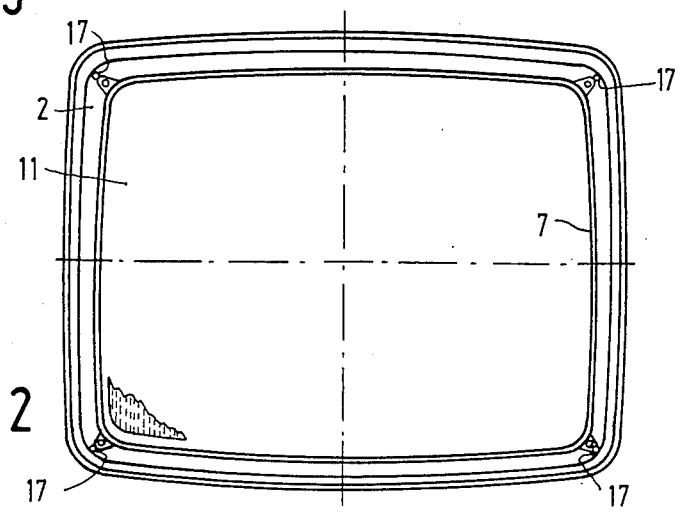
Figure 4:
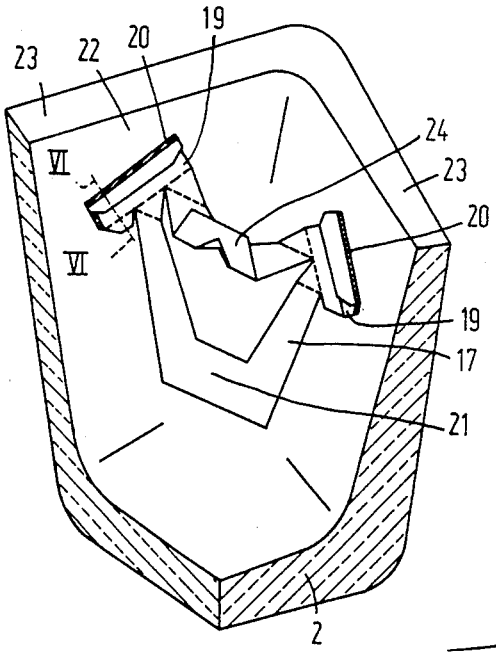
Figure 5:
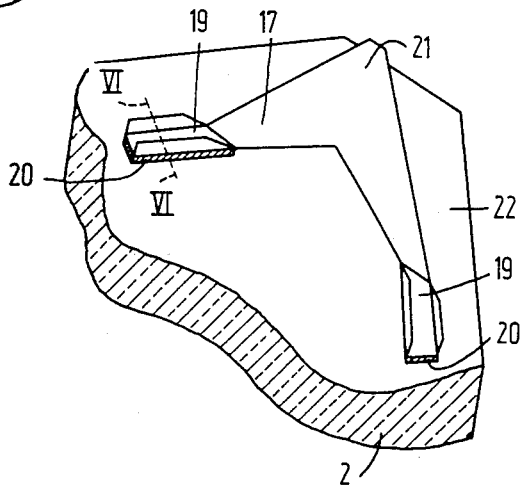
Figure 6:
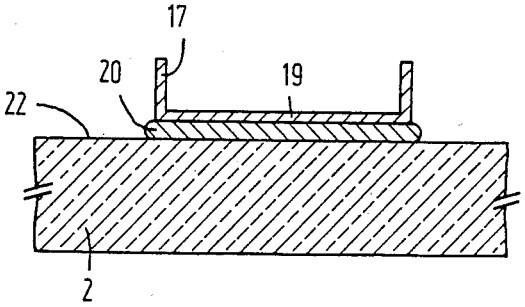

FIG. 2 is a diagrammatic plan view of a shadow mask suspended in the display window of the cathode ray tube FIG. 3 is a diagrammatic cross-section through a part of a cathode ray tube in one stage of manufacture by the method according to the invention FIG. 4 is a diagrammatic elevational view of part of a further cathode ray tube in one stage of manufacture by the method according to the invention FIG. 5 is a diagrammatic elevational view of part of yet another cathode ray tube in one stage of manufacture by means of the method according to the invention, and FIG. 6 is a diagrammatic cross-section taken on the line VI—VI in FIG. 4 and on the line VI—VI in FIG. 5.

The cathode ray tube shown in FIG. 1 is a colour television display tube of the "in-line" type. In a glass envelope 1, which is composed of a display window 2, a cone 3 and a neck 4, this neck 4 accommodates an integrated electron gun system 5 generating three electron beams 6, 7 and 8 whose axes are co-planar prior to deflection. The axis of the central electron beam 7 coincides with the tube axis 9. The inside of the display window 2 is provided with a large number of phosphor element triplets. The elements may consist of lines or dots. Each triplet comprises an element consisting of a blue-luminescing phosphor, an element consisting of a green-luminescing phosphor and an element consisting of a red-luminescing phosphor. All triplets combined constitute the display screen 10. The phosphor lines are substantially perpendicular to the said plane through the beam axes. Suspended at a short distance from the display screen 10 is a color selection electrode or shadow mask 11 having a large number of elongated apertures 12 which allow the electron beams 6, 7 and 8 to pass, each beam impinging only on phosphor elements of one colour. The three co-planar electron beams are deflected by a system of deflection coils 13 comprising a line deflection coil 14, a yoke ring 15 and a field deflection coil 16. The shadow mask 11 is suspended in the corners of the upright edge of the display window 2 by suspension means 17, as is diagrammatically shown in FIG. 2. According to the invention a simple construction of these suspension means 17 is possible when the display window 2 and the suspension means 17 are connected together free from deformation at mounting pads through metal connectors which are plastically deformed at the area of the mounting pads. The metal suspension means may have several shapes. FIG. 3 diagrammatically shows an embodiment in which the metal suspension means 17 comprise a ball-headed pin which is connected to the display window 2 by means of the metal connectors 20 through a mounting pad 19. The ball-headed pin shown has a cylindrically shaped pin 18, although the embodiment is not limited to this cylindrical shape. Alternatively, the in 18 may have a different shape, for example, a conical shape.

In the embodiments of FIGS. 4 and 5 a connection line between a mounting pad 19 and a contact point 21 of the shadow mask on the suspension means 17 constitutes an acute angle with the glass surface 22.

In the cathode ray tube according to this embodiment it is thus not necessary for the point of contact to lie vertically above the mounting pad.

The suspension means 17 both consist of a bridge having two extremities on which the glass-metal mounting pads 19 are located.

In the embodiment of FIG. 4 the display window 2 is substantially rectangular and has upright edges 23 while the suspension means 17 are located in the corners of the upright edges 23.

In the embodiment of FIG. 5 the display window 2 is rectangular and flat and the suspension means 17 are located in the corners of the display window 2.

In these embodiments the load of the suspension means 17 by the shadow mask is effected remotely from the mounting pads 19.

The suspension means 17 are connected at mounting pads 19 to the glass display window 2 (see also FIG. 6) through metal connectors 20 disposed between and contacting both the display window 2 and the suspension means 17 while using a pressure at which the connectors 20 are deformed, and at a temperature which is below the softening point of the glass of the display window 2, the softening point of the metal of the suspension means 17 and the softening point of the metal of the connectors 20.

For the connectors 20 the starting material is, for example, preformed wire pieces of aluminium (melting and softening point 659° C.) having a circular cross-section of 1 mm. These are fixed to the suspension means 17 in the form of a bridge according to FIG. 4 or 5 of 0.25 mm thick spring steel (softening point of more than 1200° C.), for example, with the aid of tags (not shown) or to the suspension means 17 in the form of a ball-headed pin according to FIG. 3 of, for example, ferrochromium having a low carbon content (softening point of more than 1000° C.). The assembly of suspension means 17 and connectors 20 is provided on the glass surface 22 (having a softening point of more than 450° C.). Subsequently the connection is established by applying a pressure of 40 $N/mm^2$ in a period of 1 second and at a temperature of 400° C., while the connectors 20 obtain a thickness of 0.2 mm.

The aluminium connection is sufficiently strong to stand thermal treatments of the cathode ray tube according to the invention at a later stage. Temperatures of more than 400° C. and below the softening point of the glass used may then be applied.

It will be evident that the invention is not restricted to the embodiments described but that many variations are possible within the scope of the invention for those skilled in the art. In the description of FIGS. 3, 4 and 5 aluminium is mentioned as a metal for the connectors. However, the invention is not limited thereto. Alternatively, it is possible to use other plastically deformable metals, such as lead.

The suspension means may additionally serve for fixing other parts besides the shadow mask. The part 24 of the suspension means 17 (see FIG. 4), for example, be used for fixing a magnetic protection shield (rear cover).

What is claimed is:

1. A cathode ray tube for displaying colour images having an envelope which is partly formed by a glass display window having metal suspension means connected thereto for suspending a colour selection electrode in the tube, characterized in that the metal suspension means comprise at least one mounting pad, and in that the mounting pads are connected directly to the display window by respective plastically deformed metal connectors, which connectors are in contact with the suspension means and the glass.

2. A cathode ray tube as claimed in claim 1, characterized in that the suspension means consist of spring steel.

3. A cathode ray tube as claimed in claim 1, characterized in that the connectors contain aluminium.

4. A cathode ray tube as claimed in claim 1, characterized in that the suspension means comprise a ball-headed pin.

5. A cathode ray tube as claimed in claim 1, characterized in that the connection line between the mounting pad and a contact point of the colour selection electrode on the suspension means constitutes an acute angle with the glass surface.

6. A cathode ray tube as claimed in claim 1 characterized in that the suspension means comprise a bridge having the mounting pad at at least one extremity.

7. A cathode ray tube as claimed in claim 6, characterized in that the mounting pad is located on each extremity of the bridge.

8. A cathode ray tube as claimed in claim 7, characterized in that the display window is substantially rectangular and has upright edges and that the suspension means are located in the corners of the upright edges.

9. A cathode ray tube as claimed in claim 7, characterized in that the display window is rectangular and flat and that the suspension means are located in the corners of the display window.

10. A cathode ray tube as in claim 1, wherein the connectors contain lead.

* * * * *